United States Patent [19]

Budzich

[11] 4,099,379

[45] Jul. 11, 1978

[54] LOAD RESPONSIVE FLUID CONTROL SYSTEM

[76] Inventor: Tadeusz Budzich, 80 Murwood Dr., Moreland Hills, Ohio 44022

[21] Appl. No.: 655,561

[22] Filed: Feb. 5, 1976

Related U.S. Application Data

[63] Continuation-in-part of Ser. No. 522,324, Nov. 8, 1974, Pat. No. 3,998,134, and Ser. No. 559,818, Mar. 19, 1975, Pat. No. 3,984,974.

[51] Int. Cl.[2] ..... F15B 13/08

[52] U.S. Cl. ..... 60/427; 60/445; 91/412; 91/421; 91/436; 91/446; 137/596.1; 137/596.13

[58] Field of Search ..... 137/596.13, 596.2, 596.1; 91/436, 437, 451, 446, 412, 421; 60/468, 420, 494, 484, 427, 445

[56] References Cited

U.S. PATENT DOCUMENTS

| | | | |
|---|---|---|---|
| 3,470,694 | 10/1969 | Budzich | 60/427 |
| 3,628,558 | 12/1921 | Bahl | 91/412 X |
| 3,630,121 | 12/1971 | Lund | 91/437 |
| 3,709,103 | 1/1977 | Dukhovny et al. | 91/437 |
| 3,744,517 | 7/1973 | Budzich | 137/596.2 |
| 3,807,447 | 4/1974 | Masuda | 91/436 X |
| 3,882,896 | 5/1975 | Budzich | 91/446 X |
| 3,984,979 | 10/1976 | Budzich | 91/446 X |

*Primary Examiner*—Gerald A. Michalsky
*Attorney, Agent, or Firm*—William N. Hogg

[57] ABSTRACT

A load responsive fluid power multiple load control system using load responsive direction and flow control valves in combination with pump control responding to highest system load. Each direction flow control valve is equipped with a load responsive pressure control which automatically regulates valve inlet pressure to maintain a constant low pressure level at the motor exhaust and a load responsive negative load control to control a constant pressure differential at the motor exhaust. The load responsive control of each direction control valve blocks the pump flow to the motor while controlling negative load, providing the motor inlet with fluid from the motor exhaust.

51 Claims, 3 Drawing Figures

LOAD RESPONSIVE FLUID CONTROL SYSTEM

This is a continuation in part of applications Ser. No. 522,324 filed Nov. 8, 1974 for "Load Responsive Fluid Control Valves" now U.S. Pat. No. 3,998,134, and Ser. No. 559,818 filed Mar. 19, 1975 for "Load Responsive Fluid Control Valves" now U.S. Pat. No. 3,984,979.

BACKGROUND OF THE INVENTION

This invention relates generally to load responsive fluid control valves and to fluid power systems incorporating such valves, which systems are supplied by a single fixed or variable displacement pump. Such control valves are equipped with an automatic load responsive control and can be used in a multiple load system, in which a plurality of loads is individually controlled under positive and negative load conditions by separate control valves.

In more particular aspects this invention relates to direction and flow control valves capable of controlling simultaneously a number of loads under both positive and negative load conditions.

In still more particular aspects this invention relates to direction and flow control valves capable of controlling simultaneously multiple positive and negative loads, which while controlling a negative load interrupt pump flow to the motor providing the motor inlet with fluid from the pressurized system exhaust.

Closed center load responsive fluid control valves are very desirable for a number of reasons. They permit load control with reduced power losses and therefore, increased system efficiency and when controlling one load at a time provide a feature of flow control irrespective of the variation in the magnitude of the load. Normally such valves include a load responsive control, which automatically maintains pump discharge pressure at a level higher, by a constant pressure differential, than the pressure required to sustain the load. A variable orifice, introduced between pump and load, varies the flow supplied to the load, each orifice area corresponding to a different flow level, which is maintained constant irrespective of variation in magnitude of the load. The application of such a system is, however, limited by several basic system disadvantages.

Since in this system the variable control orifice is located between the pump and the load, the control signal to a pressure regulating throttling device is at a high pressure level inducing high forces in the control mechanism. Another disadvantage of such a control is that it regulates the flow of fluid into the motor and therefore does not compensate for fluid compressibility and leakage across both motor and valve. Still another disadvantage of such a control is that timing of the valve and sequencing of operations must be very exact to prevent cavitation in the motor and to prevent the motor from being subjected to excessive pressures during control of negative loads. A fluid control valve for such a system is shown in U.S. Pat. No. 3,488,953 issued to Haussler.

Normally the load responsive valve control can maintain a constant pressure differential and therefore constant flow characteristics when operating only one load at a time. With two or more loads, simultaneously controlled, only the highest of the loads will retain the flow control characteristics, the speed of actuation of lower loads varying with the change in magnitude of the highest load. This drawback can be overcome in part by the provision of a proportional valve as disclosed in my U.S. Pat. No. 3,470,694 dated Oct. 7, 1969 and also in U.S. Pat. No. 3,455,210 issued to Allen on July 15, 1969. However, while those valves are effective in controlling positive loads they do not retain flow control characteristics when controlling negative loads, which instead of taking supply the energy to the fluid system and hence the speed of actuation of such a load in a negative load system will vary with the magnitude of the negative load. Especially with socalled overcenter loads, where a positive load may become a negative load, such a valve will lose its speed control characteristics in the negative mode.

This drawback can be overcome by the provision of a load responsive fluid control valve as disclosed in my U.S. Pat. No. 3,744,517 issued July 10, 1973 and my U.S. Pat. No. 3,882,896 issued May 13, 1975. However, while these valves are effective in controlling both positive and negative loads, with pump pressure responding to the highest pressure of a system load being controlled, they still utilize a controlling orifice located between the pump and the motor during positive load mode of operation and therefore control the fluid into the fluid motor instead of controlling fluid flow out of the fluid motor.

This drawback can be overcome by provision of load responsive fluid control valves as disclosed in my pending patent application Ser. No. 522,324 filed Nov. 8, 1974, entitled "Load Responsive Fluid Control Valves" now U.S. Pat. No. 3,998,134. However, while such valves maintain the pump discharge pressure higher, by a constant pressure differential, than the highest load pressure of system loads being controlled and are effective in controlling multiple positive loads, while maintaining a relatively constant down stream pressure at the motor exhaust, during control of negative loads those valves supply the motor inlet with throttled down fluid from the pump circuit, therefore using flow from the pump, while controlling a negative load. In certain fluid power control systems it is preferable, while controlling a negative load, to supply fluid to be the motor inlet from the motor exhaust circuit instead of using pump capacity.

This drawback can be overcome in part by provision of fluid control valves as disclosed in U.S. Pat. No. 3,807,447 issued to Masuda on Apr. 30, 1974. However, while those valves utilize actuator exhaust fluid for actuator inlet flow requirement when controlling negative loads they regulate actuator inlet pressure by bypassing fluid to a down steam load circuit. Masuda's valves and their proportional control system are based on series type circuit in which excess fluid flow is successively diverted from one valve to the other and in which loads arranged in series determine the system pressure. In such a system flow to the last valve operating a load must be delivered through all of the bypass sections of all of the other system valves, resulting in high fluid throttling loss and therefore low system efficiency. Those valves, without excessive pressure loss are not adaptable to parallel circuit operation and they do not provide system load control pressure signal to the pump flow control mechanism. When used with variable displacement pumps these valves are not capable of providing sufficient pressurized exhaust flow to actuator inlet during control of negative load to prevent cavitation.

SUMMARY OF THE INVENTION

It is therefore a principal object of this invention to provide a load responsive fluid control system in which improved load responsive fluid direction and flow control valves block system pump from motor inlet and supply it with system exhaust flow when controlling negative loads, while transmitting control signals to system pump to maintain the pressure of the system pump higher, by a constant pressure differential, than the highest pressure of the system positive load being controlled.

Another object of this invention is to provide a load responsive fluid control system in which load responsive fluid direction and flow control valves are provided with a pressurized exhaust manifold, flow from which supplies the inlet flow requirements of motors controlling negative loads, the system pump being utilized to prevent pressure in the exhaust manifold dropping below a certain predetermined level.

It is another object of this invention to provide a load responsive fluid control system in which load responsive fluid direction and flow control valves retain their control characteristics during control of positive loads, while responding to a low relatively constant pressure control signal from the outlets of the actuators.

It is a further object of this invention to provide a load responsive fluid control system in which load responsive fluid direction and flow control valves are provided with positive and negative load controls, the positive load controls having a priority feature permitting control of down stream valves, while the valve with priority feature is not being used.

Briefly the foregoing and other additional objects and advantages of this invention are accomplished by providing a novel load responsive fluid control system for use during proportional simultaneous control of multiple positive and negative loads. A system pump is controlled in respect to pressure signal transmitted from system valves, corresponding to the highest system load pressure. Exhaust circuit of the system is pressurized, the exhaust flow being used to provide inlet flow requirements of motors controlling negative loads. Valves with priority feature permit, while inactive, operation of the down stream valves.

Additional objects of this invention will become apparent when referring to the preferred embodiments of the invention as shown in the accompanying drawings and described in the following detailed description.

DESCRIPTION OF THE PREFERRED EMBODIMENTS

Figure 1:
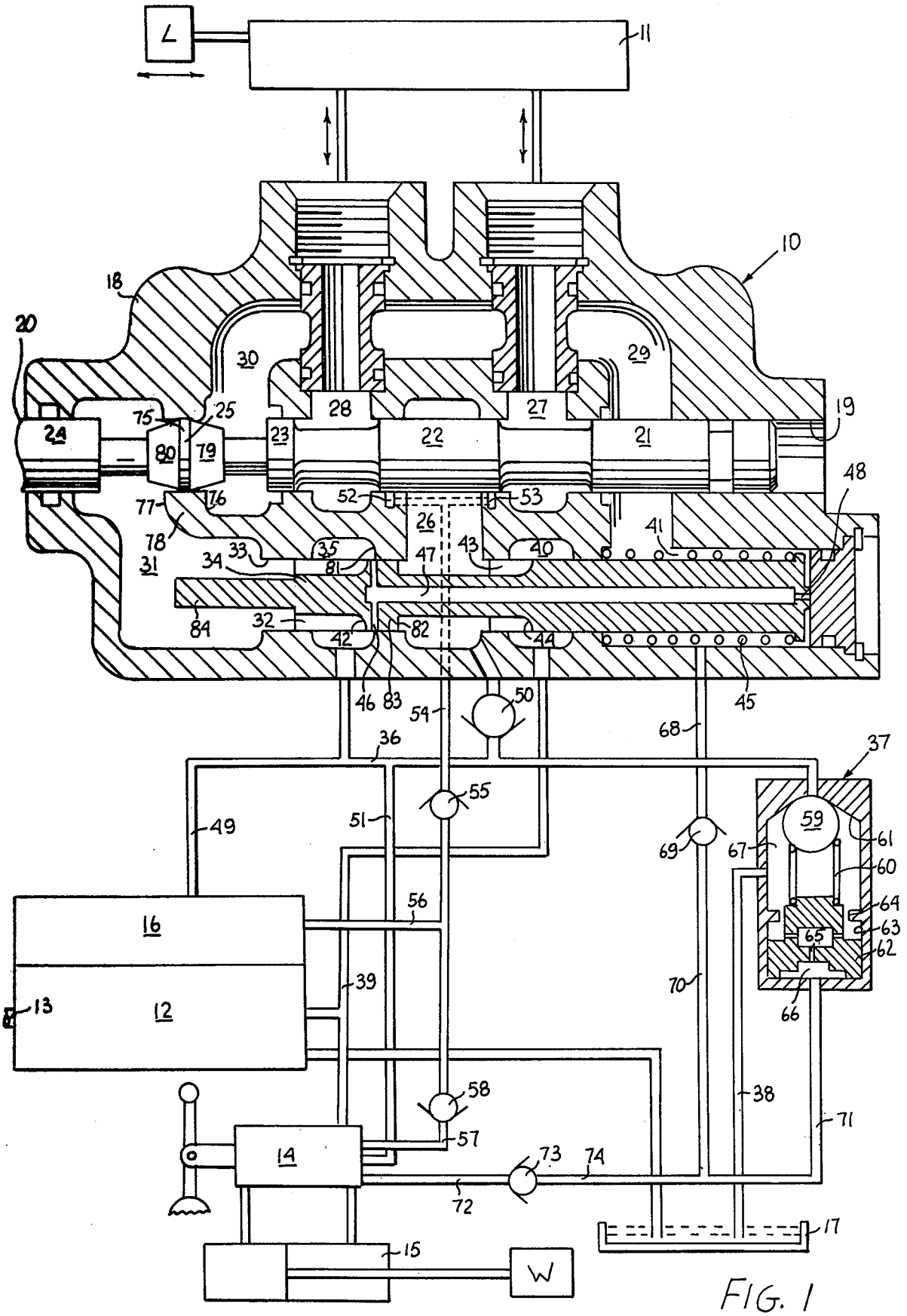
FIG. 1 is a longitudinal sectional view of an embodiment of a flow control valve having a positive and negative load control responsive to actuator down stream pressure differential for use in load responsive fluid control system, with lines, differential pressure relief valve, fixed displacement pump, second load responsive valve, exhaust relief valve and system reservoir shown diagramatically.

Referring now to the drawings and for the present to FIG. 1, embodiment of a flow control valve, generally designated as 10, is shown interposed between a diagramatically shown fluid motor 11 driving load L and a pump 12 of a fixed displacement type driven through a shaft 13 by a prime mover not shown. Similarly, a flow control valve 14, identical to the flow control valve 10, is interposed between a diagramatically shown fluid motor 15 driving a load W and the pump 12. Fluid flow from the pump 12 to flow control valves 10 and 14 is regulated by a differential pressure relief valve 16 which can be mounted as shown on the pump 12, or be an integral part of the flow control valve 10. The differential pressure relief valve 16, in a well known manner, by bypassing fluid from the pump 12 to a reservoir 17, maintains discharge pressure of the pump 12 at a level, higher by a constant pressure differential, than load pressure developed in fluid motor 11 or 15.

The flow control valve 10 is of a fourway type and has a housing 18 provided with a bore 19, axially guiding a valve spool 20. The valve spool 20 is equipped with lands 21, 22, 23 and 24 and metering land 25 which in neutral position of the valve spool 20, as shown in FIG. 1, isolate a fluid supply chamber 26, load chambers 27 and 28, outlet chambers 29 and 30 and an unloading chamber 31. The unloading chamber 31 is cross-connected through slots 32 and a control bore 33 guiding a control spool 34 to an exhaust chamber 35, which in turn is connected through exhaust line 36, an exhaust relief valve, generally designated as 37 and line 38 to the reservoir 17.

The pump 12 through its discharge line 39 is connected to a fluid inlet chamber 40. The control bore 33 connects a fluid inlet chamber 40 with the fluid supply chamber 26, the fluid exhaust chamber 35 and the fluid unloading chamber 31. The control spool 34 axially slidable in control bore 33 projects into control space 41 connected to the outlet chamber 29 and is provided with slots 32 terminating in throttling edges 42 and slots 43 terminating in throttling edges 44. The control spool 34 is biased by a control spring 45 towards position, in which slots 32 connect the unloading chamber 31 with the exhaust chamber 35 and slots 43 connect the fluid supply chamber 26 with the fluid inlet chamber 40. The control spool 34 is equipped with passages 46 and 47 and leakage orifice 48 which communicate control space 41 with the exhaust chamber 35.

Excess pump flow from the differential pressure relief valve 16 is delivered through line 49 to exhaust line 36, which communicates with the exhaust chamber 35, a bypass check valve 50, the exhaust relief valve 37 and through line 51 with all of exhaust passages of the flow control valve 14. The bypass check valve 50 is interposed between exhaust line 36 and the fluid supply chamber 26.

Positive load sensing ports 52 and 53, located between load chambers 27 and 28 and the supply chamber 26 and blocked in neutral position by valve spool 20 by land 22, are connected through signal passage 54, a check valve 55 and signal line 56 with the differential pressure relief valve 16. In a similar manner positive load sensing ports of flow control valve 14 are connected through line 57, a check valve 58 and signal line 56 to the differential pressure relief valve 16.

The exhaust relief valve, generally designated as 37, interposed between combined exhaust circuits of flow control valves 10 and 14 including bypass circuit of pump 12 and reservoir 17, is provided with a throttling member 59, biased by a spring 60 towards engagement with seat 61. The spring 60 is supported by a movable force piston 62 slidably guided in bore 63 which terminates in a stop 64. The force piston 62 is provided with leakage orifice 65 interconnecting space 66 with space 67 which is connected by line 38 with reservoir 17. Control space 41 of flow control valve 10 is interconnected for one way flow with space 66, of exhaust relief valve 37, by line 68, the check valve 69 and lines 70 and 71. In a similar manner control space of the flow control valve 14 is interconnected by line 72, a check valve 73 and lines 74 and 71 with space 66 of exhaust relief valve 37.

Metering land 25, isolating in neutral position of valve spool 20 the outlet chamber 30 from the unloading chamber 31, is equipped with sealing surface 75, centrally located between flow surfaces 76 and 77 of a web 78 and two conical metering surfaces 79 and 80. In a well known manner conical metering surfaces 79 and 80 can be substituted by suitable metering grooves.

The sequencing of the control spool 34 is such that when moved from right to left, when throttling edges 44 close communication between the inlet chamber 40 and the supply chamber 26, control surface 82 is positioned in plane of flow surface 81 at the point of opening communication between the supply chamber 26 and the exhaust chamber 35, while full flow communication still exists through grooves 32 between the unloading chamber 31 and the exhaust chamber 35. Further movement of the control spool 34 from right to left will gradually close, with throttling edge 42, communication between the exhaust chamber 35 and the unloading chamber 31, while full flow communication between the exhaust chamber 35 and the supply chamber 26 is established.

As previously described the differential pressure relief valve 16, in a well known manner, will regulate fluid flow delivered from fixed displacement pump 12 to discharge line 39, by bypassing the fluid flow to line 49 and exhaust line 36, to maintain the pressure in discharge line 39 higher, by a constant pressure differential, than the highest load pressure signal transmitted through the check valve system to the signal line 56. Therefore with valve spools of flow control valves 10 and 14 in their neutral position blocking positive load sensing ports 52 and 53, signal pressure input to the differential pressure relief valve 16 from the signal line 56 will be at minimum pressure level.

With the fixed displacement pump 12 started up the differential pressure relief valve 16 will bypass through line 49, exhaust line 36, the exhaust relief valve 37 and line 38 all of pump flow to the system reservoir 17 at minimum pressure level, equivalent to preload in the spring 60, while automatically maintaining pressure in discharge line 39 at a constant pressure, higher by a constant pressure differential, than pressure in signal line 56, which is equal to minimum pressure in exhaust line 36. Therefore all of pump flow is diverted by the differential pressure relief valve 16 to the low pressure exhaust circuit, as previously described, without entering flow passages of flow control valves 10 and 14.

Assume that while constant standby pressure condition is maintained in discharge line 39 the valve spool 20 is initially displaced from left to right to connect the load chamber 28 with the positive load sensing port 52, while lands 21, 22, 23 and metering land 25 still block communication between the supply chamber 26, load chambers 27 and 28, outlet chambers 29 and 30 and the unloading chamber 31. Assume also that actuator 11 is subjected to a positive load. Load pressure transmitted from actuator 11, the load chamber 28, the positive load sensing port 52 and signal passage 54, in a well known manner, will open the check valve 55, close the check valve 58 and reacting through signal line 56 on the differential pressure relief valve 16 increase pressure in discharge line 39 to maintain a constant pressure differential between pump pressure in discharge line 39 and load pressure in signal line 56. This pump discharge pressure will be transmitted through discharge line 39 to the fluid inlet chamber 40 and through slots 43 to the fluid supply chamber 26. Since the outlet chambers 30 and 29 are connected through control space 41, leakage orifice 48 and passages 47 and 46 to the exhaust chamber 35, which in turn is connected through slots 32 with the unloading chamber 31, the control spool 34 will be in condition of force equilibrium with the control spring 45 maintaining it in position as shown in FIG. 1.

Assume that from the position in which load chamber 28 is connected to the positive load sensing port 52 the valve spool 20 is further displaced to the right, connecting the load chamber 28 with the supply chamber 26 and the load chamber 27 with the outlet chamber 29, while metering land 25 still isolates the outlet chamber 30 from the unloading chamber 31. The pressure in the load chamber 28 will begin to rise, this change being transmitted through the positive load sensing port 52, in a manner as previously described, to the differential pressure relief valve 16, proportionally increasing the pressure in discharge line 39. This increase in positive load pressure, in a well known manner, will be transmitted to the outlet side of actuator 11, proportionally increasing the pressure in the load chamber 27 and the outlet chamber 29. This increase in pressure will be transmitted to control space 41 where, acting on the cross-sectional area of the control spool 34, it will generate a force opposing biasing force of the control spring 45. At a certain predetermined pressure differential between the load chamber 27 and therefore the outlet chamber 29 and the unloading chamber 31 the control spool 34 will move from right to left into a modulating position, regulating through throttling edge 44 the fluid flow between the inlet chamber 40 and the supply chamber 26 and the load chamber 28 to maintain the load chamber 27 at a pressure, which will provide a constant pressure differential between the load chamber 27 and the unloading chamber 31 while maintaining the system leakage. With throttling edge 44 approaching the position at which communication between the fluid inlet chamber 40 and the fluid supply chamber 26 is cut off, slots 32 still connect the unloading chamber 31 with the exhaust chamber 35.

Further displacement of the valve spool 20 to the right will position conical metering surface 80 opposite flow surface 76, creating a flow orifice between the outlet chamber 30 and the unloading chamber 31. Since, as previously described, a constant pressure differential is maintained by control spool 34 between the load chamber 27 connected to outlet chambers 29 and 30 and the unloading chamber 31, irrespective of the variation in pressure in the load chamber 28 and since the unloading chamber 31 through slots 32, the exhaust chamber 35 and the exhaust line 36 is maintained at a constant low pressure level by the exhaust relief valve 37, the flow past the metering land 25 from the load chamber 27 to the unloading chamber 31 will be proportional to the area of opening at the metering surface 80. Since the pressure differential across the orifice created by displacement of conical metering surface 80 is maintained constant by the throttling action of the control spool 34, irrespective of the magnitude of the load L, flow from the actuator 11 will be proportional to the area of opening at the metering land 25, which in turn is proportional to displacement of valve spool 20. Therefore when controlling a positive load, flow out of actuator 11 is maintained at a constant level for each specific position of valve spool 20, irrespective of the variation in load L.

Assume that the valve spools of flow control valves 10 and 14 were simultaneously actuated to a position, at which fluid flow is delivered to actuators 11 and 15. Assume also that load W is higher than load L and that both loads are positive. In a well known manner, the higher of the load pressures will be transmitted through the check valve system in the load sensing circuit, the differential pressure relief valve 16 always responding to the highest system load pressure. High pressure due to load W, transmitted from the fluid inlet chamber 40 to the fluid supply chamber 26 and the load chamber 28, will tend to increase pressure in the load chamber 27, thus increasing the pressure differential acting against the control spool 34, above its relatively constant controlled level as dictated by the biasing force of control spring 45. This increase in pressure differential, in a manner as previously described, will react on control spool 34 and will bring it into a new modulating position, in which throttling edge 44 will throttle the fluid flow from the fluid inlet chamber 40 to the fluid supply chamber 26, to maintain a constant pressure differential between the load chamber 27 and the unloading chamber 31. Therefore, irrespective of the variation in load L or W, or in variation in the pump discharge pressure during control of positive load, the control spool 34 will maintain a constant controlled pressure differential between the load chamber 27 and the unloading chamber 31, thus maintaining the flow control feature of the flow control valve 10. In a similar way the flow control feature of flow control valve 14 will be maintained, this flow control feature being retained during simultaneous operation of control valves 10 and 14.

Assume that while constant minimum standby pressure condition is maintained in discharge line 39, the valve spool 20 is initially displaced from left to right connecting the load chamber 28 with positive load sensing port 52. Assume also that the actuator 11 is subjected to a negative load, pressurizing the load chamber 27 and maintaining the load chamber 28 at minimum pressure. Therefore pressure signal, transmitted through the positive load sensing port 52, will not change the setting of differential pressure relief valve 16, the pump 12 maintaining discharge line 39 at minimum pressure level. Further movement to the right of valve spool 20 will connect the load chamber 28 with the supply chamber 26 and will also connect the load chamber 27 with the outlet chamber 29, while metering land 25 still isolates the outlet chamber 30 from the unloading chamber 31. The negative load pressure from the load chamber 27 will be transmitted to the outlet chamber 29 and therefore to control space 41 where, reacting on the cross-sectional area of the control spool 34, it will move the control spool 34 all the way from right to left, first closing off with throttling edge 44 communication between inlet chamber 40 and the supply chamber 26. A land 83 of the control spool 34 is so positioned that while throttling edge 44 is cutting off communication between the inlet chamber 40 and the supply chamber 26, control surface 82 is passing the flow surface 81, thus establishing communication between the supply chamber 26 and the exhaust chamber 35. Further movement to the left of control spool 34 will open wide communication between the supply chamber 26 and the exhaust chamber 35, throttling edge 44 cutting off communication between the unloading chamber 31 and the exhaust chamber 35. Total movement of control spool 34 to the left is limited by a stop 84 engaging the housing 18. The negative load pressure from control space 41 will also be transmitted through line 68 opening the check valve 69 and closing the check valve 73. Negative load pressure transmitted through line 71 to the force piston 62, of exhaust pressure relief valve 37, will generate a force moving the force piston upwards against the stop 64 and compressing the spring 60. Higher biasing force of the spring 60, transmitted through the throttling member 59 to seat 61, in a well known manner, will increase pressure in exhaust line 36. The increased exhaust pressure in exhaust line 36 will open bypass check valve 50, subjecting the supply chamber 26 to the increased exhaust pressure.

Further movement of valve spool 20 to the right will open communication between the outlet chamber 30 and the unloading chamber 31, with conical metering surface 80 being positioned in plane of flow surface 76. Rising pressure in unloading chamber 31, reacting on the cross-sectional area of control spool 34 and biasing force of control spring 45, will balance the force, developed on the cross-sectional area of control spool 34 due to the negative load pressure in control space 41 and will move the control spool 34 from left to right into a modulating position, in which the control spool 34, by throttling action of throttling edge 42, will maintain a constant pressure differential across the orifice created by displacement of the metering land 25. Therefore for each position of valve spool 20, corresponding to a specific area of flow across metering surfaces 80 or 79, constant flow will take place from the load chamber 27 to the unloading chamber 31, irrespective of the variation in the magnitude of the negative load in the actuator 11. High pressure flow out of actuator 11, during control of negative load, will be replenished on the other side of actuator from exhaust chamber 35 through opening created by displacement of land 83 between the exhaust chamber 35 and the supply chamber 26 and from exhaust line 36 through the bypass check valve 50, at an increased pressure level of exhaust relief valve 37, while utilizing a combined exhaust flow from the exhaust chamber 35 and the differential pressure relief valve 16. The exhaust fluid at increased pressure is supplied to the actuator inlet during control of negative load, while the fixed displacement pump 12 is completely isolated by throttling edge 44 from the supply chamber 26 and the actuator 11. Therefore, since none of the potential pump delivery is used as actuator make-up fluid during control of negative load, higher pump capacity is made available for simultaneous control of multiple positive loads. During control of two negative loads, for example loads L and W, through the well known action of check valves 69 and 73, the higher of the two negative load signals is transmitted to the exhaust relief valve 37, the lower negative pressure zone being isolated by the second check valve, thus permitting simultaneous proportional control of both negative loads. The exhaust circuit is also supplied by line 51 with exhaust fluid from the flow control valve 14, the combined exhaust flow of both control valves and the bypass flow from the differential pressure relief valve 16 being available for the make-up flow to the system actuators controlling negative loads, while full pump capacity is being saved for operation of the other positive loads.

During control of positive load increased exhaust pressure, created by exhaust relief valve 37 is detremental, since it decreases system efficiency and therefore it should be kept at minimum level. During control of negative load this exhaust pressure, created by the exhaust pressure relief valve 37, should be comparatively high, to provide actuator inlet flow requirement without cavitation. Those two requirements are conflicting. By providing a special exhaust pressure relief valve 37, which automatically increases the exhaust pressure during control of negative loads, to provide cavitation free make-up fluid to the actuator and by unloading the exhaust pressure relief valve to minimum pressure during operation of positive load, a very efficient high performance system with minimum loss is achieved.

So far operation of flow control valve 10 has been described when controlling fluid flow to actuator 11 in one direction. The flow control valve 10 is double acting since it is equipped with two positive load sensing ports 52 and 53 and two metering surfaces 80 and 79 and can control fluid flow to the actuator 11 in both directions.

Figure 2:
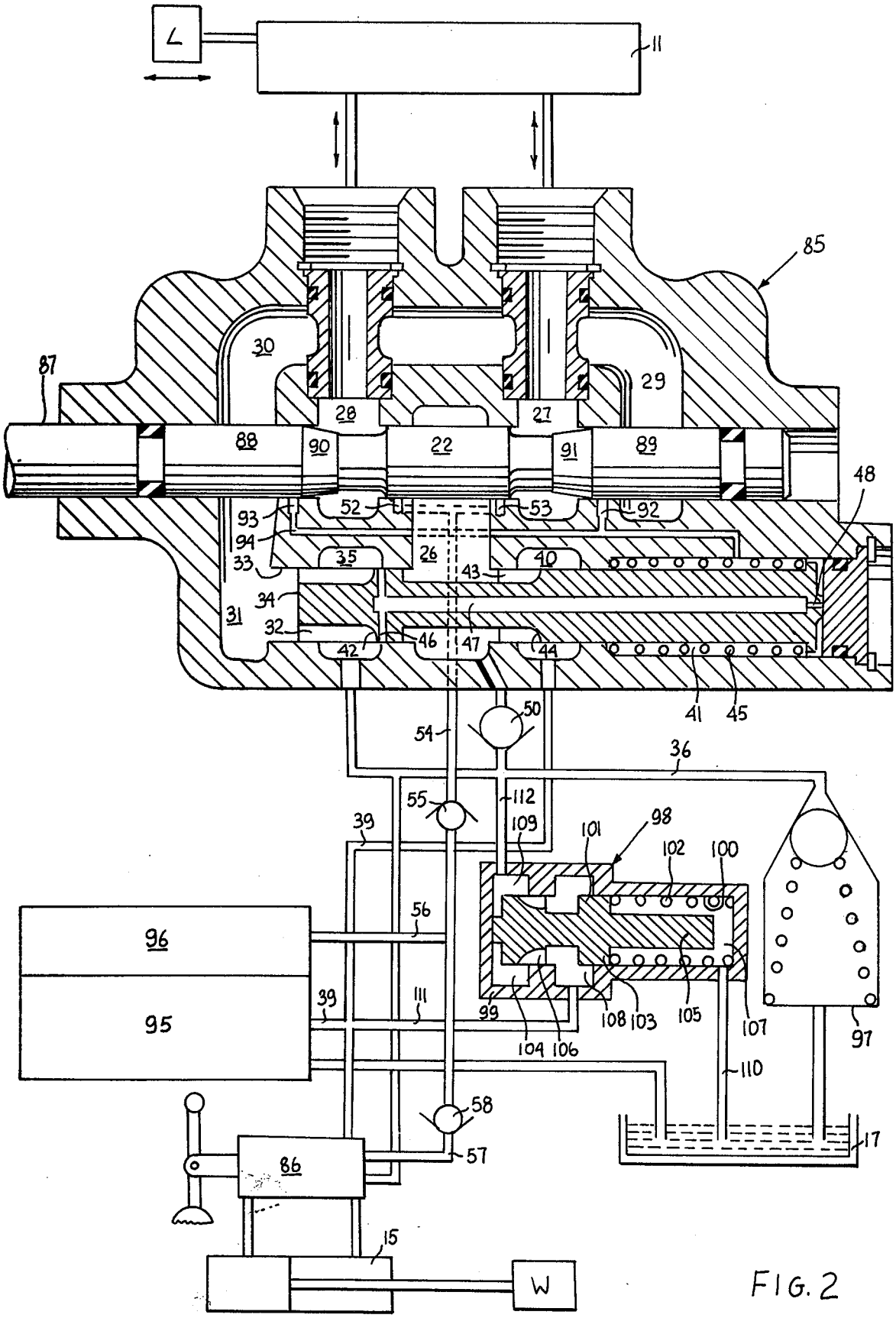
FIG. 2 is a sectional view of a similar embodiment of flow control valve of FIG. 1 used in load responsive fluid control system with lines, variable displacement pump equipped with differential pressure compensator, second load responsive valve, exhaust relief valve, exhaust pressure reducing valve and system reservoir shown diagramatically.

Referring now to FIG. 2 flow control valves, generally designated as 85 and 86, are similar to those of FIG. 1 in that they perform their control functions in control of loads L and W in a similar way. The basic function and configuration of flow control valve spool 34 is the same for flow control valves 10 and 85. Positive load sensing circuit of flow control valves 10 and 85 with their check valve systems are again identical, the positive load pressure of the highest system load being transmitted to signal line 56. However, a valve spool 87 is equipped with lands 22, 88 and 89, in neutral position isolating load chambers 28 and 27 from the supply chamber 26 and outlet chambers 29 and 30. The valve spool 87 is also provided with metering surfaces 90 and 91, positioned between the respective load and outlet chambers of flow control valve 85. Negative load sensing ports 92 and 93 blocked in neutral position of valve spool 87 by lands 88 and 89 are connected by line 94 to each other and with control space 41. A pump 95 is of a variable displacement type and is controlled by a differential pressure compensator 96 which, in a well known manner, varies the displacement of the pump 95 to maintain discharge line 39 at a pressure, higher by a constant pressure differential, than the load signal pressure transmitted to the differential pressure compensator 96 from the load sensing circuit by signal line 56. Therefore in both systems, as shown in FIGS. 1 and 2, by control of pump flow delivered to discharge line 39, a constant pressure differential is maintained between pressure in discharge line 39 and pressure in signal line 56, in response to highest system load being operated. The differential pressure compensator 96 can be an integral part of pump 95 or can be a part of flow control valve 85. Although the load control features of the systems in FIGS. 1 and 2, as will be shown are identical, the amount of flow delivered to exhaust circuit and specifically to exhaust line 36 is different for each circuit. In FIG. 1 all of the excess pump flow is delivered by the differential pressure relief valve 16 through line 49 to exhaust line 36, since the pump 12 is of a fixed displacement type. With system valve spools in neutral position all of the pump flow is directed by the differential pressure relief valve 16 to exhaust line 36. In FIG. 2 since the pump 95 is of a variable displacement type, it supplies the exact amount of fluid to satisfy the system demand, none of the pump flow being normally diverted to exhaust line 36. Therefore in the arrangement of FIG. 2 less exhaust flow is available to satisfy inlet flow requirements of system actuators during control of negative loads. Normally an actuator, in the form of a cylinder, due to presence of piston rod, displaces different flows from each cylinder port per unit length displacement of its piston. Therefore, while controlling negative load, the exhaust flow out of the cylinder might be substantially smaller than its inlet flow requirements. Under those conditions, since communication between the inlet chamber 40 and the supply chamber 26 is blocked by the control spool 34, exhaust pressure level, as maintained by exhaust pressure relief valve 97 will drop below atmospheric pressure, the exhaust pressure relief valve 97 will close entirely and cavitation will take place at the inlet side of the cylinder. In a well known manner an anticaviatation check valve could be provided between exhaust line 36 and reservoir 17, but since it can only function below atmospheric pressure the cavitation condition at actuator inlet would still likely occur. To prevent cavitation and to maintain exhaust line 36 at minimum pressure level a pressure reducing valve, generally designated as 98, is provided. Pressure reducing valve 98 has a valve housing 99 provided with a valve bore 100 axially guiding a valve spool 101, which is biased towards position as shown in FIG. 2 by a spring 102. The valve spool 101 is provided with lands 103 and 104, stop 105 and throttling slots 106. The valve housing 99 is provided with space 107 and chambers 108 and 109. Space 107 is connected through line 110 with the reservoir 17. The chamber 108 is connected by line 111 with discharge line 39, which is supplied with fluid under pressure from the pump 95. The chamber 109 is connected by line 112 with exhaust line 36. Fluid under pressure is supplied from pump 95, discharge line 39 and line 111 to the chamber 108 and through throttling slots 106 to the chamber 109, which is connected by line 112 with exhaust line 36. Pressure in the chamber 109 and in the exhaust system will begin to rise and reacting on the cross-sectional area of valve spool 101 will tend to move it from left to right, compressing the spring 102 and closing the pressure through throttling slots 106 between chambers 109 and 108. In this way pressure reducing valve 98, will throttle fluid flow from chamber 108 to chamber 109 and therefore to exhaust line 36, to maintain exhaust line 36 at a constant pressure, as dictated by the preload in the spring 102. This constant controlled pressure level is selected below controlled pressure level of exhaust pressure relief valve 97. As long as the exhaust pressure relief valve 97 maintains the exhaust system at its controlled pressure level, communication between chambers 108 and 109, of pressure reducing valve 98, will be closed and no flow from the pump 95 will be diverted into the exhaust circuit, to maintain it at a minimum constant pressure level. However, during control of negative load once the actuator inlet flow requirement will exceed the actuator outlet flow, the exhaust pressure relief valve 97 will close, pressure in the exhaust system will drop to the control pressure setting of the pressure reducing valve 98 and the motor exhaust flow will be supplemented from the pump circuit by the pressure reducing valve 98, to maintain the actuator inlet at the required pressure. Therefore during control of negative load only the difference between the actuator inlet flow requirement and the actuator exhaust flow will be supplied to the exhaust circuit from the pump 95. This feature not only improves the efficiency of the system, but greatly extends the capacity of the pump of variable displacement type, to perform useful work in control of positive loads.

Assume that while constant standby pressure condition is maintained in discharge line 39 the valve spool 87 is initially displaced from left to right, connecting positive load sensing port 52 with the load chamber 28 and also connecting negative load sensing port 92 with the load chamber 27. Assume also that the fluid motor is subjected to a positive load, with the load chamber 28 pressurized and the load chamber 27 subjected to minimum pressure. Minimum pressure signal, transmitted from the negative load sensing port 92 through line 94 to control space 41, will leave the control spool 34 in the position as shown in FIG. 2. The positive load pressure signal, transmitted through the positive load sensing port 52 will, in a manner as previously described, bring the discharge pressure of the pump 95 in discharge line 39 to a level, higher by a constant pressure differential, than the load pressure signal transmitted through the load sensing circuit and signal line 56 to the differential pressure compensator 96.

Assume that spool 87 is further displaced from left to right connecting the load chamber 28 with the supply chamber 26 and the load chamber 27, through the metering surface 91, with the outlet chamber 29. The pressure in the load chamber 27 will begin to rise and will be transmitted through negative load sensing port 92 and line 94 to the control space 41, where it will react on the cross-sectional area of control spool 34. With the increasing pressure differential between pressure in control space 41 and outlet chamber 30 the control spool 34 will move into a modulating position, throttling fluid flow from the inlet chamber 40 to the supply chamber 26 by throttling edge 44, to maintain, as previously described when referring to FIG. 1, a constant pressure differential between the load chamber 27 and the outlet chamber 29, flow between those chambers being proportional to the area of orifice created by the metering surface 91 and therefore proportional to the displacement of valve spool 87 and independent of the variation in the magnitude of the positive load L controlled by the flow control valve 85.

Assume that valve spool 87 was displaced from left to right, connecting load chamber 28 with positive load sensing port 52 and the load chamber 27 with the negative load sensing port 92. Assume also that the actuator 11 is subjected to a negative load, with the load chamber 27 pressurized and the load chamber 28 subjected to minimum pressure. The minimum pressure signal, transmitted from the load chamber 28 through the positive load sensing circuit and signal line 56 to the differential pressure compensator 96 will maintain the discharge line 39 of the pump 95 at minimum pressure level. Negative load pressure signal, transmitted from the negative load sensing port 92 through line 94 to control space 41, will react on the cross-sectional area of control spool 34 moving it all the way from right to left and in a manner, as previously described when referring to FIG. 1, will close off communication between the inlet chamber 40 and the supply chamber 26, connect the supply chamber 26 with the exhaust chamber 35 and close off communication by throttling edge 42 between the exhaust chamber 35 and the outlet chamber 30.

Assume that valve spool 87 is further displaced from left to right, connecting the load chamber 28 with the supply chamber 26 and also connecting through metering surface 91 the load chamber 27 with the outlet chamber 29. The pressure in the outlet chambers 29 and 30 will begin to rise reacting on the cross-sectional area of the control spool 34 and generating a force acting in the same direction as the biasing force of the control spring 45 and opposing a force developed on the cross-sectional area of the control spool 34 by pressure in control space 41. In a manner, as previously described when referring to FIG. 1, the control spool 34 will move into a modulating position, throttling fluid flow between the outlet chamber 30 and the exhaust chamber 35 by throttling edge 42, to maintain a constant pressure differential between the load chamber 27 and the outlet chamber 29. With constant pressure differential maintained across an orifice created by metering surface 91, the fluid flow from the load chamber 27 to the outlet chamber 29 will be proportional to the area of the created orifice and therefore to the displacement of spool 87 from its neutral position and completely independent of the magnitude of the negative load L. The inlet flow requirement of actuator 11 will be supplied directly from the exhaust chamber 35 to the supply chamber 26, this flow if required being supplemented by flow through bypass check valve 50, supplied by pressure reducing valve 98 from the outlet of pump 95.

Figure 3:
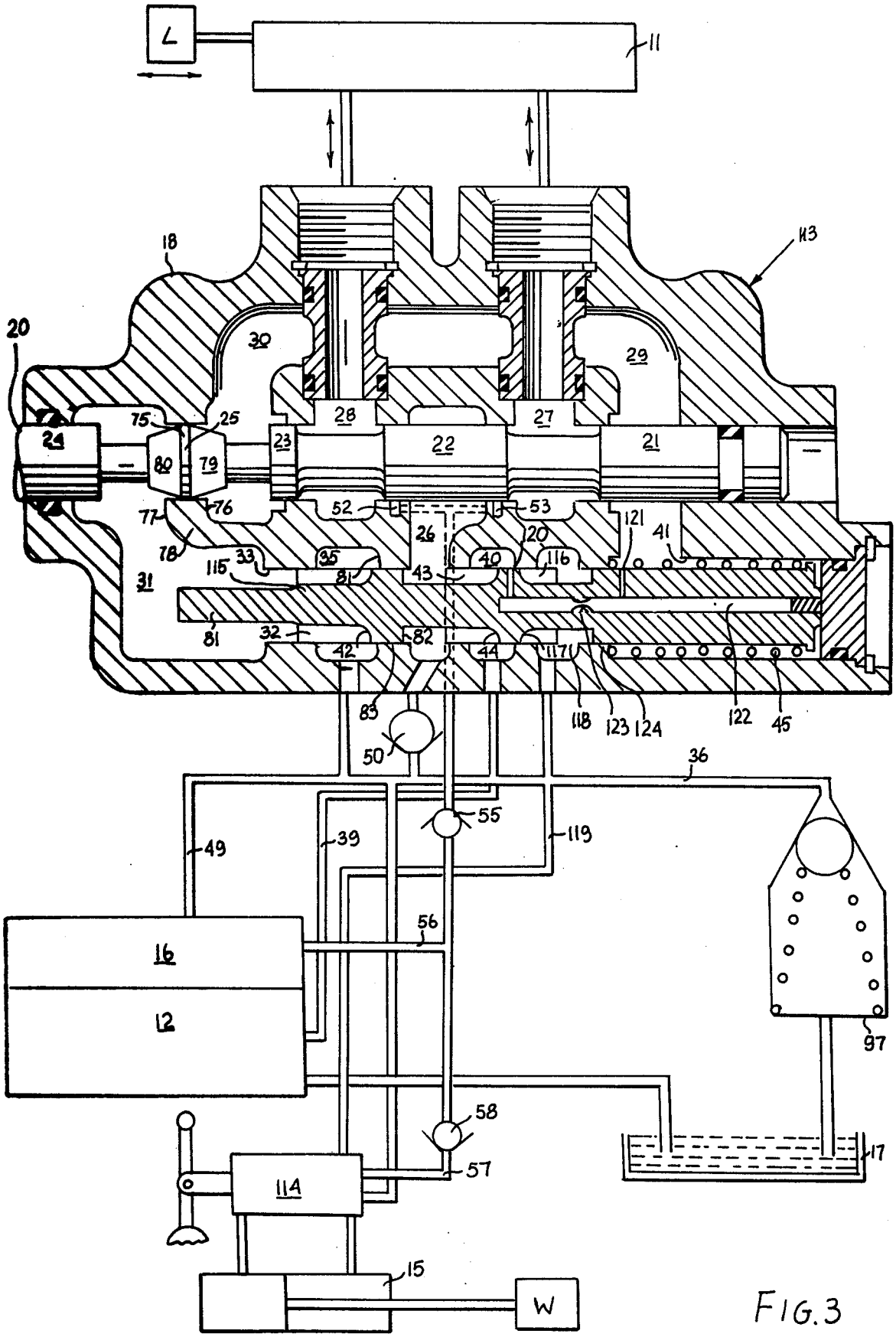
FIG. 3 is a longitudinal sectional view of an embodiment of a flow control valve having a positive load control with priority feature and negative load control, positive and negative load controls being responsive to actuator down stream pressure differential, for use in load responsive fluid control system, with lines, differential pressure relief valve, fixed displacement pump, second load responsive valve, exhaust relief valve and system reservoir shown diagramatically.

Referring now to FIG. 3 control valves, generally designated as 113 and 114, are similar to flow control valves 10 and 14 of FIG. 1. and they perform their control functions in control of loads L and W in a similar way. A control spool 115 of FIG. 3 is similar to the control spool 34 of FIG. 1 and has identical sections for control of positive and negative loads. However, the control spool 115 is also equipped with bypass slots 116 having throttling edges 117 between a bypass chamber 118 and the inlet chamber 40. The bypass chamber 118 is connected through line 119 with inlet chamber of flow control valve 114.

The sequencing of the control spool 115 is such, that when moved from right to left it will first open communication through throttling edge 117 between the inlet chamber 40 and the bypass chamber 118, while full flow passage still exists through grooves 43 between the inlet chamber 40 and the supply chamber 26 and through grooves 32 between the exhaust chamber 35 and the unloading chamber 31. Further movement of the control spool 115 from right to left will gradually enlarge flow passage between the bypass chamber 118 and the inlet chamber 40, while proportionally reducing flow passage between the inlet chamber 40 and the supply chamber 26, until throttling edge 44 will disrupt communication between the inlet chamber 40 and the supply chamber 26, with control surface 82 positioned in plane of flow surface 81, at the point of opening communication between the supply chamber 26 and the exhaust chamber 35, while full flow communication still exists, through grooves 32, between the unloading chamber 31 and the exhaust chamber 35. Further movement of the control spool 115 from right to left will gradually close, with throttling edge 42, communication between the exhaust chamber 35 and the unloading chamber 31, while full flow communication between the exhaust chamber 35 and the supply chamber 26 is established.

The control spool 115 is also equipped with passage 120 and 121 connected by passage 122 containing a restriction orifice 123. A web 124 separates control space 41 from the bypass chamber 118. The passage 120 communicates with the inlet chamber 40 and passage 121 communicates with control space 41, with spool 115 in position as shown in FIG. 3. With control spool 115 in position as shown in FIG. 3 throttling edges 117 of slots 116 isolate the bypass chamber 118 from the inlet chamber 40. The configurations of spools 20 and the load sensing circuits of the flow control valve 10 of FIG. 1 are identical to that of flow control valve 113 of FIG. 3.

With the pump 12 of fixed displacement type started up, in a well known manner, as previously described, the differential pressure relief valve 16 maintains discharge line 39 at minimum pressure level. The pump discharge pressure from the inlet chamber 40 is transmitted through passage 120, restriction orifice 123, passages 122 and 121 to the control space 41 and outlet chambers 29 and 30. With the valve spool 20 in its neutral position, as shown in FIG. 3, outlet chambers 29 and 30 are isolated. The rising pressure in control space 41, reacting on the cross-sectional area of control spool 115, will generate sufficient force to move the control spool 115 against biasing force of control spring 45 to a position, at which passage 121 becomes blocked by guiding surface of web 124. In this position the control spool 115 will interconnect the bypass chamber 118 with the inlet chamber 40, while communication between the inlet chamber 40 and the supply chamber 26 is still maintained. Therefore as long as the pump 12 is generating pressure it is directly connected through the inlet chamber 40, the bypass chamber 118 and line 119 with the inlet chamber of flow control valve 114.

During the control of single or multiple negative or positive loads the flow control valves of FIG. 3 will perform in an identical way as the flow control valves of FIG. 1. There is however one additional function that the flow control valve 113 of FIG. 3 can perform and this relates to priority control feature of the valve.

Assume that during simultaneous control of positive loads L and W by flow control valves 113 and 114 with valve spools moved from left to right, load L becomes the higher of the two. Assume also that the combined flow demand of the flow control valves 113 and 114 will exceed the capacity of the pump 12. Pump pressure in discharge line 39 will start dropping below the level of the constant pressure differential maintained by the differential pressure relief valve 16 and therefore the difference between pressure due to load L and pressure in discharge line 39 will decrease. As a result the force equilibrium acting on the control spool 15 will be disturbed. The control spool 115, under action of force developed on its cross-sectional area by pressure in the unloading chamber 31, will move from left to right, moving throttling edge 44 out of its throttling position and throttling with throttling edge 117 fluid flow from the inlet chamber 40 to the bypass chamber 118. In this way flow control spool 115, by throttling action of the throttling edge 117, will maintain a constant pressure differential between the load chamber 27 and the unloading chamber 31, this constant control differential being maintained by regulating the bypass flow to the actuator 15. Due to this bypass throttling action the flow control valve 113 has a priority feature, which permits proportional control of load L, when the combined flow demand of flow control valves 113 and 114 exceeds the flow capacity of the pump 12. If during simultaneous control of loads L and W, load W is the higher of the two and when flow demand of the flow control valves 113 and 114 exceeds the capacity of the pump 12, the system pressure will drop to a level, equivalent to load pressure L, at which time, in a manner as previously described, the control spool 15 will regulate, by throttling with the throttling edge 117, the bypass flow from the inlet chamber 40 to the bypass chamber 118, to maintain a constant pressure differential between the load chamber 27 and the unloading chamber 31. Therefore, irrespective of the variation in the magnitude of the loads L and W, during simultaneous operation of flow control valves 113 and 114, once the combined flow demand of the flow control valves exceeds the capacity of the pump 12, the flow control valve 113 always retains the priority feature.

While controlling positive loads the passage 121 is normally blocked by the guiding surface of the web 124 and therefore no flow takes place through the restriction orifice 123. When controlling a negative load passage 120 becomes blocked by the guiding surface of the web dividing the inlet chamber 40 and supply chamber 26. Therefore the arrangement of passages 120 and 121 with the restricting orifice 123 serves only one purpose and that is to connect the inlet chamber 40 with the bypass chamber 118 with the valve spool 20 of the flow control valve 113 in its neutral position. During normal operation of the control spool 115 when controlling positive or negative loads the flow transfer action of passages 120 and 121 stops. During the control of positive priority type load the small flow from passage 120 to passage 121 through restriction orifice 123 is insignificant due to the fact that the metering land 25 connects the outlet chamber 30 and the unloading chamber 31.

Although the preferred embodiments of this invention have been shown and described in detail it is recognized that the invention is not limited to the precise form and structure shown and various modifications and rearrangement as will occur to those skilled in the art upon full comprehension of this invention may be resorted to without departing from the scope of the invention as defined in the claims.

What is claimed is:

1. Multiple load responsive valve assemblies each comprising a housing having a fluid inlet chamber connected to pump means, a fluid supply chamber, first and second load chambers, outlet fluid conducting means, fluid exhaust means connected to reservoir means and pressure sensing means, first valve means for selectively interconnecting said fluid load chambers with said pressure sensing means, said fluid supply chamber and said fluid exhaust means, variable metering orifice means responsive to movement of said first valve means and operable to throttle fluid flow between said load chambers and said fluid exhaust means, second valve means having first fluid throttling and fluid isolating means between said fluid inlet chamber and said fluid supply chamber and second fluid throttling means between said load chambers and said fluid exhaust means, said second valve means having means responsive to pressure differential at variable pressure level acting across said variable orifice means and operable to maintain said pressure differential at a relatively constant level while pressure at said variable orifice means is permitted to vary, fluid replenishing means to interconnect for fluid flow said fluid supply chamber and said fluid exhaust means when said fluid isolating means isolates said fluid supply chamber from said fluid inlet chamber and control means operably connected through said pump means to said inlet chambers of said valve assemblies, control line means interconnecting said control means with said pressure sensing means of said valve assemblies, control signal direction phasing means in each of said control line means, said control means responsive to highest pressure in any of said load chambers of valve assemblies operating loads and operable to vary fluid flow delivered from said pump means to load system to maintain a constant pressure differential between pressure in said inlet chambers and said maximum pressure in said load chamber.

2. Multiple load responsive valve assemblies as set forth in claim 1 wherein said first valve means includes a valve spool axially guided in a valve bore and movable from a neutral position to at least two actuated positions, said valve spool isolating said load chambers from said supply chamber and said fluid exhaust means when in neutral position and when displaced from neutral position first uncovering a control signal passage means in the region of said spool bore between one of said load chambers and said fluid supply chamber.

3. Multiple load responsive valve assemblies as set forth in claim 1 wherein said fluid replenishing means have fluid connecting means on said second valve means operable to connect for fluid flow said fluid supply chamber with said fluid exhaust means when said fluid isolating means isolates said fluid inlet chamber from said fluid supply chamber.

4. Multiple load responsive valve assemblies as set forth in claim 1 wherein said fluid replenishing means have suction check valve means interconnecting for one way fluid flow said fluid exhaust means and said fluid supply chambers.

5. Multiple load responsive valve assemblies as set forth in claim 4 wherein duct means interconnect said fluid exhaust means of said valve assemblies with said reservoir means, exhaust pressure relief valve means in said duct means interposed between said valve assemblies and said reservoir means said suction check valve means interconnecting said fluid supply chambers of said valve assemblies through said fluid exhaust means with said duct means upstream of said exhaust pressure relief valve means.

6. Multiple load responsive valve assemblies as set forth in claim 1 wherein said control means has bypass means to vary fluid flow delivered from said pump means to said load system and fluid conducting means to conduct said fluid from said bypass means to said fluid replenishing means.

7. Multiple load responsive valve assemblies as set forth in claim 1 wherein said control means has pump displacement changing control means to vary fluid flow delivered from said pump means to said multiple load responsive valve assemblies.

8. Multiple load responsive valve assemblies as set forth in claim 7 wherein constant pressure reducing valve means interconnects said inlet chambers of said valve assemblies and said fluid exhaust means, duct means interconnecting said fluid exhaust means of said valve assemblies with said reservoir means, exhaust pressure relief valve means in said duct means interposed between said valve assemblies and said reservoir means, said constant pressure reducing valve means operable to maintain said duct means upstream of said exhaust pressure relief valve means at a constant pressure level lower than pressure setting of said exhaust pressure relief valve means when said exhaust pressure relief valve means stop passing fluid from said load responsive valve assemblies to said reservoir means.

9. Multiple load responsive valve assemblies as set forth in claim 1 wherein said first throttling means has means operable to control fluid flow from said fluid inlet chamber to said fluid supply chamber to maintain said pressure differential across said variable orifice means at a first relatively constant preselected level when one of said load chambers is interconnected with said fluid supply chamber and said load chamber is pressurized.

10. Multiple load responsive valve assemblies as set forth in claim 9 wherein said second throttling means has means operable to control fluid flow from said load chamber to said exhaust means to maintain said pressure differential across said variable orifice means at a second relatively constant preselected level when one of said load chambers is connected through said variable orifice means to said exhaust means and said load chamber is pressurized.

11. Multiple load responsive valve assemblies as set forth in claim 1 wherein said housing has a fluid outlet chamber selectively communicable with said load chambers and a fluid exhaust chamber communicable with said exhaust means, said variable metering orifice means selectively interconnecting for fluid flow said fluid outlet chamber and said fluid exhaust chamber.

12. Multiple load responsive valve assemblies as set forth in claim 11 wherein said second throttling means is positioned to throttle fluid flow between said fluid exhaust chamber and said fluid exhaust means.

13. Multiple load responsive valve assemblies as set forth in claim 11 wherein said second valve means is responsive to pressure in said fluid outlet chamber and said fluid exhaust chamber.

14. Multiple load responsive valve assemblies as set forth in claim 1 wherein said control signal direction phasing means include check valve means.

15. A load responsive valve assembly comprising a housing having a fluid inlet chamber connected to pump means, a fluid supply chamber, first and second load chambers, outlet fluid conducting means, fluid exhaust means connected to reservoir means and pressure sensing means, first valve means for selectively interconnecting said fluid load chambers with said pressure sensing means, said fluid supply chamber and said fluid exhaust means, variable metering orifice means responsive to movement of said first valve means and operable to throttle fluid flow between said load chambers and said fluid exhaust means, second valve means having first throttling means between said fluid inlet chamber and said fluid supply chamber and second fluid throttling means between said load chambers and said fluid exhaust means, said second valve means having means responsive to pressure differential at variable pressure level acting across said variable orifice means and operable to maintain said pressure differential at a relatively constant level while pressure at said variable orifice means is permitted to vary, said second valve means having isolating means to isolate said fluid supply chamber from said fluid inlet chamber and connecting means to connect said fluid supply chamber with said exhaust means when said fluid supply chamber is connected to one of said load chambers by said first valve means and said load chamber is not pressurized, duct means interconnecting said fluid exhaust means of said valve assembly with said reservoir means, exhaust pressure relief valve means interposed between said duct means and said reservoir means, suction check valve means interconnecting said duct means and said fluid supply chamber of said valve assembly and control means operably connected through said pump means to said inlet chamber of said valve assembly, control line means interconnecting said control means with said pressure sensing means of said valve assembly, check valve means in said control line means, said control means responsive to pressure in said load chamber of said valve assembly operating load and operable to vary fluid flow delivered from said pump means to said valve assembly to maintain a constant pressure differential between pressure is said inlet chamber and said pressure in said load chamber.

16. A load responsive valve assembly as set forth in claim 15 wherein said control means has fluid bypass means to vary fluid flow delivered from said pump means and fluid conducting means to conduct said fluid from said bypass means to said duct means upstream of said exhaust pressure relief valve means.

17. A load responsive valve assembly as set forth in claim 15 wherein said first valve means includes a valve spool axially guided in a valve bore and movable from a neutral position to at least two actuated positions, said valve spool isolating said load chambers from said supply chamber and said fluid exhaust means when in neutral position and when displaced from neutral position first uncovering a control signal passage means in the region of said spool bore between one of said load chambers and said fluid supply chamber.

18. A load responsive valve assembly as set forth in claim 15 wherein said housing has a fluid outlet chamber selectively communicable with said load chambers and a fluid exhaust chamber communicable with said exhaust means, said variable metering orifice means selectively interconnecting for fluid flow said fluid outlet chamber and said fluid exhaust chamber.

19. A load responsive valve assembly as set forth in claim 18 wherein said second throttling means is positioned to throttle fluid flow between said fluid exhaust chamber and said fluid exhaust means.

20. A load responsive valve assembly as set forth in claim 18 wherein said second valve means is responsive to pressure in said fluid outlet chamber and said fluid exhaust chamber.

21. A load responsive valve assembly as set forth in claim 15 wherein said housing has a fluid bypass chamber adjacent to said fluid inlet chamber, said second valve means having priority throttling and bypass means operable to throttle or bypass flow from said fluid inlet chamber to said fluid bypass chamber.

22. A load responsive valve assembly as set forth in claim 21 wherein said second valve means has bypass actuating means to open communication through said priority throttling and bypass means between said fluid inlet chamber and said fluid bypass chamber when said first valve means is in a neutral position and said variable orifice means remains closed.

23. A load responsive valve assembly as set forth in claim 15 wherein said housing has a fluid outlet chamber interposed between said load chambers and said fluid exhaust means, said variable metering orifice means selectively interconnecting one of said load chambers with said outlet chamber.

24. A load responsive valve assembly as set forth in claim 15 wherein said first valve means includes a valve spool axially guided in a valve bore and movable from a neutral position to at least two actuated positions, an outlet chamber in said housing, said valve spool isolating said load chambers from said supply chamber and said outlet chamber when in neutral position and when displaced from neutral position position first uncovering a control signal port means in the region of said valve spool bore between one of said load chambers and said fluid outlet chamber.

25. A load responsive valve assembly as set forth in claim 24 wherein said second valve means is responsive to pressure in said control signal port means and pressure in said outlet fluid conducting means.

26. A load responsive valve assembly as set forth in claim 15 wherein said control means has pump displacement changing control means to vary fluid flow delivered from said pump means to said load responsive valve assembly.

27. A load responsive valve assembly as set forth in claim 26 wherein constant pressure reducing valve means interconnects said inlet chamber of said valve assembly and said duct means upstream of said exhaust pressure relief valve means and operable to maintain said duct means upstream of said exhaust pressure relief valve means at a constant pressure level lower than pressure setting of said exhaust pressure relief valve means when said exhaust pressure relief valve means stop passing fluid from said load responsive valve assembly.

28. A load responsive valve assembly comprising a housing having a fluid inlet chamber connected to pump means, a fluid supply chamber, first and second load chambers, outlet fluid conducting means, fluid exhaust means connected to reservoir means and pressure sensing port means, first valve means for selectively interconnecting said fluid load chambers with said pressure sensing port means, said fluid supply chamber and said fluid exhaust means, variable metering orifice means responsive to movement of said first valve means and operable to throttle fluid flow between said load chambers and said fluid exhaust means, second valve means having fluid throttling means, fluid isolating means between said fluid inlet chamber and said fluid supply chamber, said second valve means having means responsive to pressure differential at variable pressure level acting across said variable orifice means and operable to maintain said pressure differential at a relatively constant level while pressure at said variable orifice means is permitted to vary, fluid replenishing means to interconnect for fluid flow said fluid supply chamber and said fluid exhaust means when said fluid isolating means isolates said fluid supply chamber from said fluid inlet chamber and control means operably connected through said pump means to said inlet chamber of said valve assembly, control line means interconnecting said control means with said pressure sensing port means of said valve assembly, control signal direction phasing means in said control line means, said control means responsive to pressure in said load chambers of said valve assembly operating a load and operable to vary fluid flow delivered from said pump means to said valve assembly to maintain a constant pressure differential between pressure in said inlet chamber and said maximum pressure in said load chamber.

29. A load responsive valve assembly as set forth in claim 28 wherein said first valve means includes a valve spool axially guided in a valve bore and movable from a neutral position to at least two actuated positions, said valve spool isolating said load chambers from said supply chamber and said fluid exhaust means when in neutral position and when displaced from neutral position first uncovering a control signal passage means in the region of said spool bore between one of said load chambers and said fluid supply chamber.

30. A load responsive valve assembly as set forth in claim 28 wherein said fluid replenishing means have fluid connecting means on said second valve means operable to connect for fluid flow said fluid supply chamber with said fluid exhaust means when said fluid isolating means isolates said fluid inlet chamber from said fluid supply chamber.

31. A load responsive valve assembly as set forth in claim 28 wherein said fluid replenishing means have suction check valve means interconnecting for one way fluid flow said fluid exhaust means and said fluid supply chamber.

32. A load responsive valve assembly as set forth in claim 28 wherein exhaust pressure relief valve means in said fluid exhaust means is interposed between said valve assembly and said reservoir means.

33. A load responsive valve assembly as set forth in claim 28 wherein said control means has bypass means to vary fluid flow delivered from said pump means to said load system and fluid conducting means to conduct said fluid from said bypass means to said fluid replenishing means.

34. A load responsive valve assembly as set forth in claim 28 wherein said control means has pump displacement changing control means to vary fluid flow delivered from said pump means to said load responsive valve assembly.

35. A load responsive valve assembly as set forth in claim 28 wherein said throttling means has means operable to control fluid flow from said fluid inlet chamber to said fluid supply chamber to maintain said pressure differential across said variable orifice means at a relatively constant preselected level when one of said load chambers is interconnected with said fluid supply chamber and said load chamber is pressurized.

36. A load responsive valve assembly as set forth in claim 28 wherein said housing has a fluid outlet chamber selectively communicable with said load chambers and a fluid exhaust chamber selectively communicable with said exhaust means, said variable metering orifice means selectively interconnecting for fluid flow said fluid outlet chamber and said fluid exhaust chamber.

37. A load responsive valve assembly as set forth in claim 28 wherein said housing has a fluid bypass chamber adjacent to said fluid inlet chamber, said second valve means having priority throttling and bypass means operable to throttle or bypass flow from said fluid inlet chamber to said fluid bypass chamber.

38. A valve assembly comprising a housing having a fluid inlet chamber, a fluid supply chamber, first and second load chambers, an outlet chamber, an exhaust chamber, and fluid exhaust means, first valve means for selectively interconnecting said fluid load chambers with said fluid outlet chamber and said fluid supply chamber, variable metering orifice means responsive to movement of said first valve means and operable to throttle fluid between said outlet chamber and said exhaust chamber, second valve means having fluid throttling means, fluid isolating means between said inlet chamber and said supply chamber, said second valve means having means responsive to pressure differential at variable pressure level acting across said variable orifice means and operable to maintain said pressure differential relatively constant while pressure at said variable orifice means is permitted to vary, and fluid replenishing means to interconnect for fluid flow said fluid supply chamber and said fluid exhaust means when said fluid isolating means isolates fluid supply chamber from said fluid inlet chamber.

39. A valve assembly as set forth in claim 38 wherein said fluid replenishing means have fluid connecting means on said second valve means to connect said fluid supply chamber to said fluid exhaust means when said isolating means isolate said fluid supply chamber from said fluid inlet chamber.

40. A valve assembly as set forth in claim 38 wherein said fluid replenishing means have check valve means interconnecting for one way fluid flow said fluid exhaust means and said supply chamber.

41. A valve assembly as set forth in claim 38 wherein said exhaust means is connected to an exhaust relief valve means.

42. A valve assembly as set forth in claim 38 wherein said first valve means includes a valve spool axially guided in a valve bore and movable from a neutral position to at least two actuated positions, control signal passage means in the region of said spool bore between said load chambers and said supply chamber, said valve spool isolating said load chambers from said supply chamber and said outlet chamber and blocking said control signal passage means when in neutral position and when displaced from neutral position uncovering said control signal passage means.

43. A valve assembly as set forth in claim 42 wherein said control signal passage means have connecting passage means for connecting said control signal passage means with pump flow control means.

44. A valve assembly as set forth in claim 38 wherein said housing has a fluid bypass chamber adjacent to said fluid inlet chamber, said second valve means having priority throttling and bypass means operable to throttle or bypass flow from said fluid inlet chamber to said fluid bypass chamber.

45. A valve assembly as set forth in claim 44 wherein said second valve means has bypass actuating means to open communication through said priority throttling means and bypass means between said fluid inlet chamber and said fluid bypass chamber when said first valve means is in a neutral position isolating said load chambers from said supply chamber and said outlet chamber.

46. A valve assembly as set forth in claim 45 wherein said bypass actuating means has positioning means of said second valve means to maintain full flow communication between said inlet chamber and said bypass chamber.

47. A valve assembly as set forth in claim 38 wherein said second valve means has throttling means between said exhaust chamber and said fluid exhaust means, said second valve means being responsive to pressure differential across said variable metering orifice means.

48. A valve assembly supplied with pressure fluid by a pump, said valve assembly comprising a housing having a fluid inlet chamber, a fluid supply chamber, first and second load chambers, load pressure sensing means operable to transmit a control signal to control means operable to vary flow delivered from said pump to said inlet chamber, and fluid exhaust means, first valve means for selectively interconnecting said fluid load chambers with said load pressure sensing means, said fluid supply chamber and said fluid exhaust means, variable metering orifice means responsive to movement of said first valve means and operable to throttle fluid flow between said load chambers and said fluid exhaust means, second valve means having fluid throttling means said second valve means having means responsive to pressure differential at variable pressure level acting across said variable orifice means and operable to maintain said pressure differential at a relatively constant level while pressure at said variable orifice means is permitted to vary, said second valve means having isolating means to isolate said fluid supply chamber from said fluid inlet chamber, and connecting means to connect said fluid supply chamber with said exhaust means when said fluid supply chamber is connected to one of said load chambers by said first valve means and said load chamber is not pressurized.

49. A valve assembly as set forth in claim 48 wherein said second valve means has fluid throttling means between said load chambers and said fluid exhaust means.

50. A valve assembly as set forth in claim 48 wherein exhaust pressure relief valve means is positioned in said fluid exhaust means.

51. A valve assembly as set forth in claim 50 wherein constant pressure reducing valve means interconnects said inlet chamber of said valve assembly and said fluid exhaust means upstream of said exhaust pressure relief valve means and operable to maintain said fluid exhaust means upstream of said exhaust pressure relief valve means at a constant pressure lever lower than pressure setting of said exhaust pressure relief valve means when said exhaust pressure relief valve means stop passing fluid from said fluid exhaust means.

* * * * *